US006250104B1

(12) United States Patent
Bostic

(10) Patent No.: US 6,250,104 B1
(45) Date of Patent: Jun. 26, 2001

(54) TEMPERATURE CONTROL ASSEMBLY AND METHOD FOR TEMPERATURE CONTROL

(75) Inventor: William Bostic, Cedar Falls, NC (US)

(73) Assignee: R. G. Barry Corporation, Pickerington, OH (US)

( * ) Notice: Subject to any disclaimer, the term of this patent is extended or adjusted under 35 U.S.C. 154(b) by 0 days.

(21) Appl. No.: 09/540,143

(22) Filed: Mar. 30, 2000

Related U.S. Application Data

(60) Provisional application No. 60/127,096, filed on Mar. 31, 1999.

(51) Int. Cl.[7] ..... F25D 3/08

(52) U.S. Cl. ..... 62/530; 62/60; 62/457.4

(58) Field of Search ..... 62/530, 457.4, 62/60, 457.2, 371; 165/46; 220/62.12, 592.16, 592.2, 592.03

(56) References Cited

U.S. PATENT DOCUMENTS

| | | | |
|---|---|---|---|
| D. 343,088 | | 1/1994 | Owens . |
| D. 346,062 | | 4/1994 | Owens . |
| 3,879,598 | | 4/1975 | Darling . |
| 4,060,276 | | 11/1977 | Lindsay . |
| 4,143,765 | * | 3/1979 | Moss, III . |
| 4,258,706 | | 3/1981 | Shank . |
| 4,413,857 | | 11/1983 | Hayashi . |
| 4,514,993 | * | 5/1985 | Johnson . |
| 4,650,245 | | 3/1987 | Nazar . |
| 4,756,311 | | 7/1988 | Francis, Jr. . |
| 5,150,707 | | 9/1992 | Anderson . |
| 5,190,350 | | 3/1993 | Hwang et al. . |
| 5,205,610 | | 4/1993 | Reninger . |
| 5,260,536 | | 11/1993 | Peery . |
| 5,307,647 | | 5/1994 | McClure . |
| 5,339,541 | | 8/1994 | Owens . |
| 5,345,784 | | 9/1994 | Bazemore et al. . |
| 5,357,693 | | 10/1994 | Owens . |
| 5,424,519 | | 6/1995 | Salee . |
| 5,478,988 | | 12/1995 | Hughes et al. . |
| 5,516,193 | | 5/1996 | Simpson . |
| 5,533,361 | * | 7/1996 | Halpern ..... 62/457.2 |
| 5,545,198 | | 8/1996 | Owens . |
| 5,575,812 | | 11/1996 | Owens . |
| 5,601,744 | | 2/1997 | Baldwin . |
| 5,630,959 | | 5/1997 | Owens . |
| 5,727,844 | | 3/1998 | O'Quinn et al. . |
| 5,785,427 | | 7/1998 | Godshaw . |
| 5,842,571 | * | 12/1998 | Rausch ..... 62/457.7 X |
| 6,007,572 | | 12/1999 | Baldwin . |
| 6,066,840 | | 5/2000 | Baldwin et al. . |

* cited by examiner

*Primary Examiner*—William Doerrler
*Assistant Examiner*—Chen-Wen Jiang
(74) *Attorney, Agent, or Firm*—Merchant & Gould P.C.

(57) ABSTRACT

A temperature control assembly is described including a covering with a top panel and side panels constructed and arranged to provide an open bottom side and an interior compartment for receiving an article whose temperature is to be adjusted. The temperature control assembly also includes at least one thermal unit sized for controlling the temperature of the article provided within the interior compartment and at least one pocket provided on one of the interior surfaces of the side panels for holding the thermal unit. In one embodiment, the top panel of the covering has an opening for accessing the interior compartment, that allows a user of the temperature control assembly to easily carry an article within the temperature control assembly. A method of providing temperature control is also described where a temperature control assembly is provided and the temperature of an article within the interior compartment of the temperature control assembly is adjusted.

26 Claims, 2 Drawing Sheets

FIG. 1
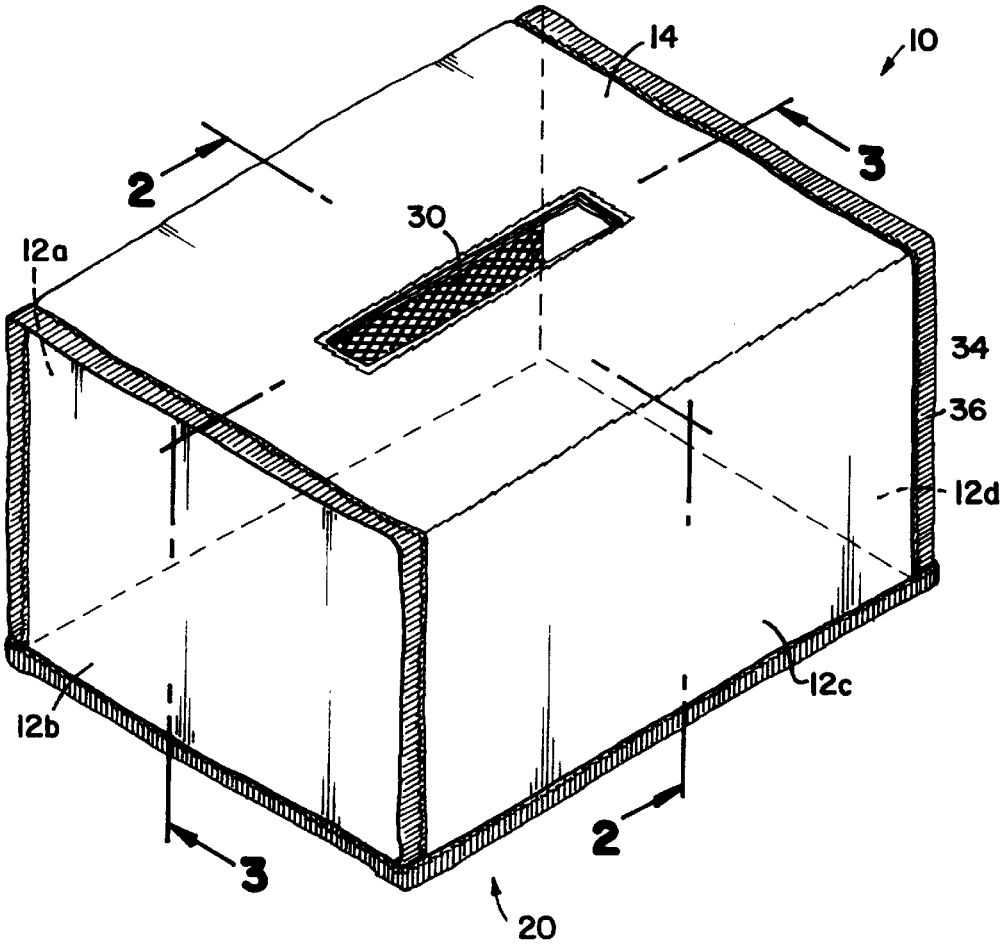
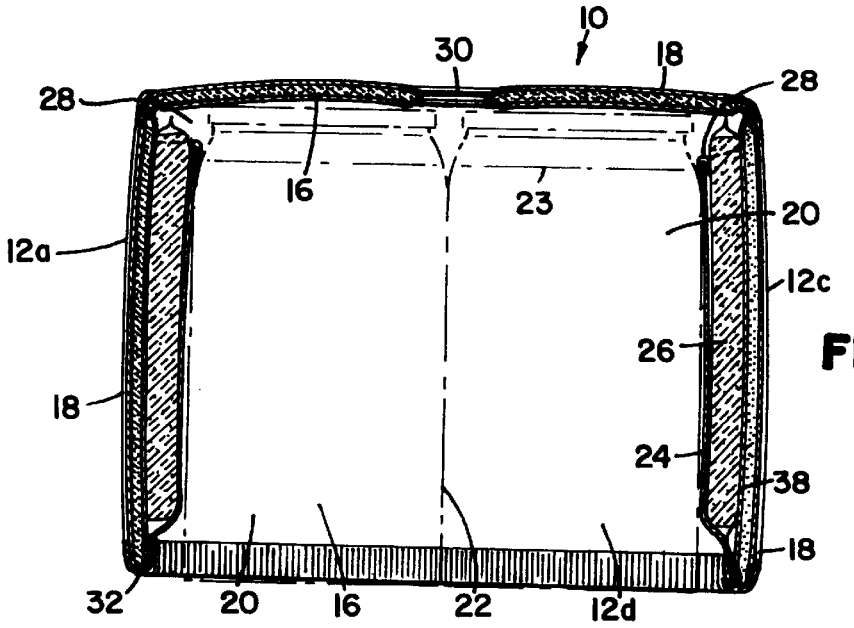
FIG. 2

TEMPERATURE CONTROL ASSEMBLY AND METHOD FOR TEMPERATURE CONTROL

This application claims priority from provisional application Ser. No. 60/127,096, filed Mar. 31, 1999, and which is incorporated herein by reference.

FIELD OF THE INVENTION

The present invention relates to an assembly for temperature control of an article and a method for temperature control of an article, in particular for temperature control of a beverage container or containers.

BACKGROUND OF THE INVENTION

Various temperature control assemblies, suited for carrying beverage containers and keeping them cool or warm are known. Exemplary types of containers are described by U.S. Pat. No. 5,570,588 to Lowe; U.S. Pat. No. 5,421,172 to Jones; U.S. Pat. No. 5,241,835 to Ascome; U.S. Pat. No. 4,812,054 to Kirkendall; U.S. Pat. No. 3,998,072 to Shaw; U.S. Pat. No. 4,383,422 to Gordon et al.; U.S. Pat No. 4,388,813 to Gardner et al.; U.S. Pat. No. 5,005,374 to Spitler; U.S. Pat. No. 4,393,665 to Gardner et al.; U.S. Pat. No. 3,974, 658 to Starratt; and U.S. Pat. No. 4,019,340 to Conklin.

SUMMARY OF THE INVENTION

A temperature control assembly is described including a covering having a top panel and a plurality of side panels that are constructed and arranged to provide an open bottom side and an interior compartment, where each of the panels has an interior surface that forms the interior compartment, and each panel also has an exterior surface. The temperature control assembly further includes at least one thermal unit sized for controlling the temperature of an article provided within the interior compartment and at least one pocket provided on the interior surface of at least one of the side panels, where the pocket is constructed and arranged for holding the thermal unit. The pocket may have an open edge for selectively inserting and removing the thermal unit.

The temperature control assembly may also include in one embodiment an opening in the top panel for accessing the interior compartment. The opening is preferably sized to permit human fingers to access the interior compartment. In another embodiment of the temperature control assembly, the open edge of the pocket is provided proximate to the top panel.

A method of providing temperature control is also described comprising the steps of providing a temperature control assembly over an article for controlling the temperature of the article and adjusting the temperature of the article. The method may alternatively include the steps of cooling the thermal unit or heating the thermal unit. The method may include the steps of cooling the thermal unit by placing it in a refrigerator or preferably a freezer, or alternatively heating the thermal unit using a microwave oven. In one embodiment, the method includes removing the thermal unit from the pocket when the article reaches a desired temperature.

BRIEF DESCRIPTION OF THE DRAWINGS

The invention may be more completely understood in consideration of the following detailed description of various embodiments of the invention in connection with the accompanying drawings, in which:

FIG. 1 is a perspective view of one embodiment of the temperature control assembly of the invention;

FIG. 2 is a cross-sectional view of the temperature control assembly of FIG. 1, taken along line 2—2 of FIG. 1, where beverage containers are shown in phantom positioned in an interior compartment of the assembly.

Figure 3:
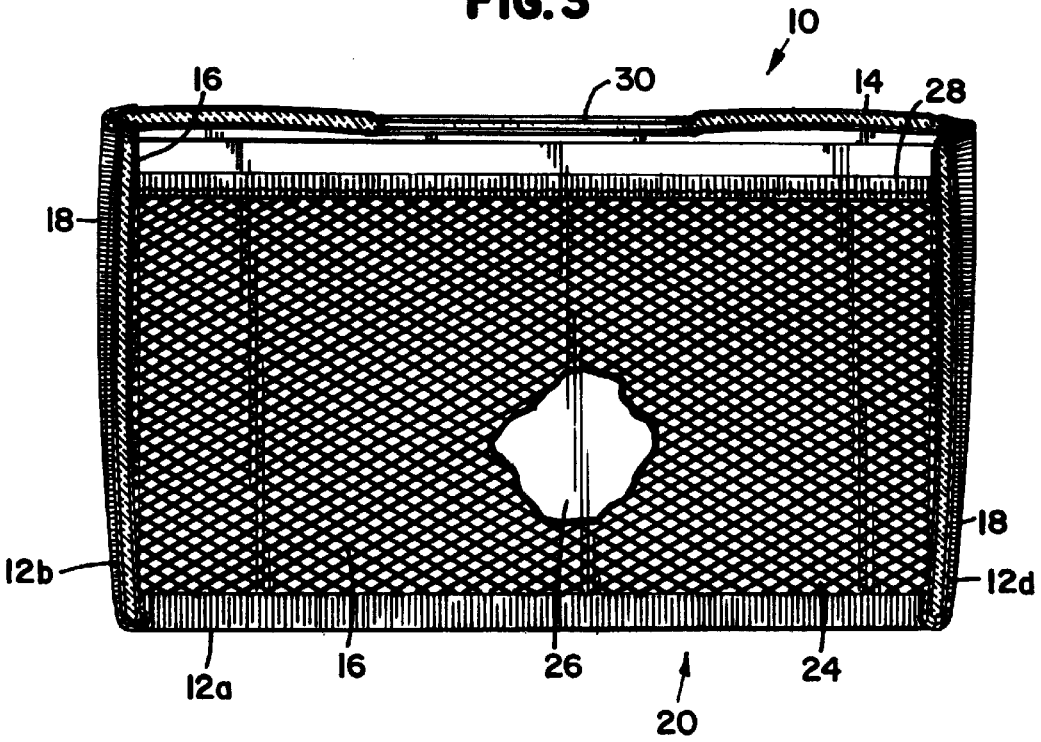
FIG. 3 is also a cross-sectional view of the temperature control assembly of FIG. 1, taken along line 3—3 of FIG. 1, showing pockets positioned on an interior surface of the assembly.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE VARIES EMBODIMENTS

The present invention is believed to be applicable to a variety of assemblies and methods for providing temperature control to an article. The invention is particularly advantageous for providing temperature control to beverage containers. For example, the invention is especially useful for providing temperature control to a conventional six-pack of cans or bottles. While the present invention is not so limited, an appreciation of various aspects of the invention will be gained through a discussion of the fabrication process and characteristics of such a device in connection with the examples provided below.

Referring to FIGS. 1–3, a temperature control assembly according to the present invention is shown at reference numeral 10. The temperature control assembly is provided for adjusting and/or maintaining the temperature of an article such as a beverage container or containers for an extended period of time. A preferred type of article which can be temperature controlled by the assembly 10 is a conventional six-pack of cans or bottles. The temperature control assembly 10 can be referred to as a poncho.

The poncho 10 includes a four side panels 12*a*–12*d* and a top panel 14. Each panel includes an interior surface 16 and an exterior surface 18, as shown in FIG. 2. The panels are arranged to provide an open bottom side and an interior compartment 20. The interior compartment 20 is defined by the interior surfaces 16 of the panels. The interior compartment 20 is sized to receive the article to be provided with the temperature control. For example, the interior compartment 20 may be sized to receive a six-pack of beverage containers for temperature control. In FIG. 3, two cans 22 are shown in phantom positioned in the interior compartment. A plastic ring assembly 12 is also shown in phantom joining the cans.

The open bottom side of the assembly is advantageous because it allows drainage of any condensation out of the interior compartment. By reducing the prolonged contact of the side panels with moisture, the durability of the assembly may be improved. The drainage provided by the open bottom side also provides convenience to users of the poncho, because it eliminates any need to drain the assembly after use.

The open bottom side also provides manufacturing advantages. In addition, placement of the poncho 10 over the an article, such as a six-pack, is more convenient using an open bottom configuration than a closed bottom configuration.

The open bottom design results in immediate proximity between the sidewall thermal units and the article to be cooled or heated.

As shown in FIGS. 2 and 3, a pocket 24 may be provided on at least one of the interior surfaces 16 of the side panels 12*a*14 12*d*, for holding a thermal unit 26 to provide the temperature control function. The pocket 24 is capable of receiving the thermal unit 26, and is configured so that the thermal unit can be placed within the pocket 24 and removed from the pocket 24 selectively. For example, the pocket 24 may have an open edge 28 for allowing the selective removal of the thermal unit 26. Preferably the open edge 28 of the pocket 24 is provided proximate to the top panel 14, so that when the poncho is in its typical position, with the open bottom facing down, the thermal unit 26 will be retained in the pocket 24 and will not fall out of the open edge 28.

Preferably, two pockets 24 are included in each temperature control assembly, and the pockets 24 are provided on the interior surfaces of opposing side panels, such as on side panels 12*a* and 12*c*. In this preferred embodiment, two thermal units 26 are also provided in the assembly 10, where one thermal unit 26 is provided in each pocket 24. Other arrangements of thermal units are also possible and contemplated by the invention. Opposing side panels 12*b* and 12*d* could be provided with pockets in the alternative. Two pockets and two thermal units could be provided on each of two adjacent side panels. In addition, it is possible to provide four pockets and four thermal units, one on the interior surface of each side panel. Alternatively, a thermal unit could be provided on only one side.

The top panel 14 may have an opening 30 in one embodiment of the invention. The opening 30 is useful for allowing access to the interior compartment 20, so that the beverage manufacturer's packaging carrying apparatus of the article may be utilized when the poncho is in place over the article. The opening 30 may preferably be sized to permit access by human fingers to the interior compartment. For example, a conventional six-pack often is held together with a plastic assembly having six rings, one ring fitted over the top of each container, so that two fingers may be used to carry the six-pack using some type of a plastic ring assembly. A six pack of bottles is also often held together with a plastic assembly that can be used to carry the six pack with two fingers. Preferably, the opening 30 of the poncho is sized to accommodate use of these types of carrying apparatuses.

The thermal unit 26 is provided as the device for controlling the temperature of the article to be received within the interior compartment, such as the six-pack. The thermal unit may be a heat sink for removing heat from the beverage containers and keeping the beverage cool for an extended period of time. In the alternative, the thermal unit may be a heat source for providing heat to the beverage containers and keeping the beverage containers warm for an extended period of time. When a cooling function is desired, the thermal unit may be cooled to about 30° F. to 32° F., or preferably 20° F. to 25° F. For example, the thermal unit 26, when provided at a temperature of about 26° F., will provide a six pack of twelve ounce cans, originally provided at a temperature of about 70° F., at a temperature of about 50–55° F. after 30 minutes when the assembly 10 is kept at room temperature. When a warming function is desired, the thermal unit may be used to maintain a temperature in the range of about 140° F. to about 200° F., or about 177° F.

The thermal unit 26 includes a sealed envelope 32 containing a thermal retention fluid. The thermal retention fluid can be cooled by placement in a freezer, for example, or by other methods. The thermal unit 26 can be manufactured according to U.S. Pat. No. 5,630,959 to Owens, the entire disclosure of which is incorporated herein by reference. Furthermore, the thermal unit 26 can be purchased from Vesture Corporation under the mark Microcoreo®. It should be appreciated that various other types of thermal units can be used provided that they are capable of being cooled or heated. Preferably, a freezer is used to cool the thermal unit. In order to optimize cooling performance, the thermal unit should be taken through a phase change during cooling to utilize the latent energy of the phase change during cooling of the article. Preferably, the thermal unit is also capable of being warmed by being submersed in a warm fluid or by microwave radiation. The fluid within the thermal unit can be water or other types of aqueous slurry, including water with adjuvant such as preservative. For cooling functions, a fluid having a phase change temperature of about 32° F. is preferred. Alternative fluids that will accomplish the cooling function for residential or commercial use include a brine solution, such as 12% sodium chloride or calcium chloride by weight, or 15% propylene glycol. Preferably, the thermal unit 26 is sufficiently flexible to provide for ease of insertion into the open edge of the pocket 24 when the contents are liquid.

Heat transfer from the beverage container to the heat sink or thermal unit 26 is enhanced by conductive-transfer due to the close proximity of the poncho 10 to the article or beverage load. The poncho 10 may be preferably sized to provide close contact of the thermal unit 26 with the article to be cooled or heated, in order to provide the conductive thermal transfer between the thermal unit 26 and the article. Where the article to be cooled is a number of aluminum cans, the high thermal conductivity of aluminum will facilitate the heat transfer process.

It is generally preferred that the thermal unit is one which resists leakage even if punctured. Foam may be provided within the sealed envelope to retain fluid and prevent leakage of fluid in the event that the envelope is punctured. Preferably, compressed foam is provided within the sealed envelope to provide a high level of moisture retention. Other types of moisture retaining devices may also be provided with the sealed envelope as contemplated by the invention.

The four side panels 12*a*–12*d* may be four separate panels of material, or in the alternative, the four side panels 12*a*–12*d* may be provided by one piece of material that is configured to form four sections. Alternatively, the top panel 14 and one or more of the side panels 12*a*–12*d* may also be formed from the same material. In one preferred embodiment, the four side panels 12*a*–12*d* and top panel 14 are sewn together at seams 34. Preferably, the seams 34 are covered with a binder material 36 to improve the durability of the poncho 10.

The side panels, top panel, or combinations thereof may preferably include a layer of insulating material 38 to reduce heat transfer from the exterior of the poncho to the interior compartment. The insulating material will also reduce the transfer of heat from the interior compartment to the exterior, when the thermal unit is used to warm the articles. Preferably, the four side panels and the top panel include an insulating layer. Another preferred component of the panels is a layer of material that resists moisture. Because condensation may accumulate on the thermal unit, beverage containers, or other articles, the interior surfaces of the panels are likely to be in contact with moisture.

The pockets 24 are preferably made of a material that does not significantly impede heat transfer from the thermal unit to the adjacent beverage containers within the interior compartment. It is also preferable that the pockets allow drainage of condensation. A mesh material is useful for allowing heat transfer and providing drainage and is preferably used as the material for the pockets 24.

When using the poncho 10 to provide temperature control to an article, the thermal unit 26 or thermal units are adjusted to the desired temperature. The thermal units may be cooled by placing them in a refrigerator or preferably a freezer, or by using other methods known in the art. In the alternative, the thermal units may be heated to the desired temperature, using, for example, a microwave oven, or many other methods of heating. When the thermal units have reached the desired temperature, they are inserted into the open edge 28 of the pocket 24 within the interior compartment 20 of the poncho 10. The poncho 10 is then slipped over the article for which temperature control is desired. When the article reaches the desired temperature, the insulation in the panels of the poncho 10 controls the heat gain of the article from the environment. When the article reaches the desired temperature, the thermal unit or units may be removed from the pockets for additional thermal adjustment.

As noted above, the present invention is applicable to a number of temperature control assemblies and methods for providing temperature control. Accordingly, the present invention should not be considered limited to the particular examples described above, but rather should be understood to cover all aspects of the invention as fairly set out in the accompanying claims. Various modifications, equivalent processes, as well as numerous structures to which the present invention may be applicable will be readily apparent to those of skill in the art to which the present invention is directed upon review of the present specification. The claims are intended to cover such modifications and devices.

What is claimed is:

1. A temperature control assembly comprising:

(a) a covering having a top panel and a plurality of side panels constructed and arranged to provide an open bottom side and an interior compartment, each of the panels having an interior surface for forming the interior compartment and an exterior surface;

(b) at least one thermal unit sized for controlling the temperature of an article provided within the interior compartment; and (c) at least one pocket provided on the interior surface of at least one of the side panels, the pocket being constructed and arranged for holding the thermal unit.

2. The temperature control assembly of claim 1 wherein the top panel has an opening for accessing the interior compartment.

3. The temperature control assembly of claim 1 wherein the opening in the top panel is sized to permit human fingers to access the interior compartment.

4. The temperature control assembly of claim 1 wherein the pocket has an open edge for selectively inserting and removing the thermal unit therefrom, wherein the open edge is provided proximate to the top panel.

5. The temperature control assembly of claim 1 wherein the pocket comprises a mesh material.

6. The temperature control assembly of claim 1 wherein the at least one thermal unit comprises two thermal units and the at least one pocket comprises two pockets, wherein the two pockets are provided on interior surfaces of opposing side panels.

7. The temperature control assembly of claim 1 wherein the covering is sized to slip over an article to accommodate the article within the interior compartment.

8. The temperature control assembly of claim 1 wherein the covering is sized for receipt of conventional six-pack of containers in the interior compartment.

9. The temperature control assembly of claim 1 wherein the plurality of side panels comprises four side panels.

10. The temperature control assembly of claim 1 wherein the side panels and top panels are sewn together.

11. The temperature control assembly of claim 1 wherein the side panels and top panels are sewn together at seams and the seams include a binding material.

12. The temperature control assembly of claim 1 wherein the thermal unit comprises a sealed envelope containing fluid.

13. The temperature control assembly of claim 12 wherein the sealed envelope further contains a fluid retention device.

14. The temperature control assembly of claim 12 wherein the sealed envelope further contains foam.

15. The temperature control assembly of claim 14 wherein the foam is compressed.

16. The temperature control assembly of claim 4 wherein the open edge of the pocket is sized to allow for easy insertion of the thermal unit into the pocket.

17. The temperature control assembly of claim 1 wherein the panels include a layer of material that is moisture resistant.

18. The temperature control assembly of claim 1 wherein side panels include a layer of insulation provided between the interior surfaces and the exterior surfaces.

19. The temperature control assembly of claim 1 wherein the top panel includes a layer of insulation provided between the interior surface and the exterior surface.

20. A temperature control assembly comprising:

(a) a covering having a top panel and a plurality of side panels constructed and arranged to provide an open bottom side and an interior compartment, each of the panels having an interior surface for forming the interior compartment and an exterior surface;

(b) at least one thermal unit sized for controlling the temperature of an article provided within the interior compartment;

(c) at least one pocket provided on the interior surface of at least one of the side panels, the pocket being constructed and arranged for holding the thermal unit; and (d) a conventional six pack of containers received within the interior compartment.

21. A method of providing temperature control comprising the steps of:

(a) providing a temperature control assembly over an article for controlling the temperature of the article, the temperature control assembly comprising:

(i) a covering having a top panel and a plurality of side panels constructed and arranged to provide an open bottom side and an interior compartment, each of the panels having an interior surface for forming the interior compartment and an exterior surface, (ii) at least one thermal unit sized for controlling the temperature of the article provided within the interior compartment, and (iii) at least one pocket provided on the interior surface of at least one of the side panels, the pocket being constructed and arranged for holding the thermal unit; and (b) adjusting the temperature of the article.

22. The method of providing temperature control of claim 21 further comprising a step of:

(a) cooling the thermal unit to a temperature of about 20° F. to 25° F. prior to said step of providing a temperature control assembly over an article.

23. The method of providing temperature control of claim 22 wherein the thermal unit is cooled by placing the thermal unit in a freezer or refrigerator.

24. The method of providing temperature control of claim 21 further comprising a step of:

(a) heating the thermal unit to a temperature of about 140° F. to 200° F. prior to said step of providing a temperature control assembly over an article.

25. The method of providing temperature control of claim 24 wherein the thermal unit is heated in a microwave oven.

26. The method of providing temperature control of claim 21 further comprising a step of:

(a) removing the thermal unit from the pocket when the article reaches a desired temperature.

* * * * *

UNITED STATES PATENT AND TRADEMARK OFFICE

CERTIFICATE OF CORRECTION

PATENT NO. : 6,250,104 B1
DATED : June 26, 2001
INVENTOR(S) : Bostic

It is certified that error appears in the above-identified patent and that said Letters Patent is hereby corrected as shown below:

Column 2,
Line 21, "VARIES" should read -- VARIOUS --

Column 3,
Line 6, 12a14 12d" should read -- 12a-12d --

Signed and Sealed this

Twenty-first Day of May, 2002

*Attest:*

*Attesting Officer*

JAMES E. ROGAN
*Director of the United States Patent and Trademark Office*